US005776330A

United States Patent [19]

D'Muhala

[11] Patent Number: 5,776,330

[45] Date of Patent: Jul. 7, 1998

[54] ELECTROLYTIC DECONTAMINATION METHODS AND APPARATUS

[75] Inventor: Thomas F. D'Muhala, Raleigh, N.C.

[73] Assignee: Corpex Technologies, Inc., Durham, N.C.

[21] Appl. No.: 646,770

[22] Filed: May 8, 1996

[51] Int. Cl.[6] ..... C25F 1/04; C25F 7/00

[52] U.S. Cl. ..... 205/687; 205/702; 205/705; 205/723; 205/771; 205/43; 205/44; 205/45; 205/46; 204/275

[58] Field of Search ..... 205/687, 702, 205/705, 723, 771, 43, 44, 45, 46; 204/275

[56] References Cited

U.S. PATENT DOCUMENTS

| | | | |
|---|---|---|---|
| 3,294,664 | 12/1966 | Franklin | 204/224 |
| 3,546,088 | 12/1970 | Barkman et al. | 204/224 |
| 3,751,343 | 8/1973 | Macula et al. | 204/224 |
| 3,779,887 | 12/1973 | Gildone | 204/224 |
| 4,002,456 | 1/1977 | Maas | 71/3 |
| 4,014,773 | 3/1977 | Furuya | 204/206 |
| 4,217,192 | 8/1980 | Lerch et al. | 204/149 |
| 4,304,654 | 12/1981 | Norris | 204/212 |
| 4,421,556 | 12/1983 | Windt et al. | 75/63 |
| 4,431,501 | 2/1984 | Leppänen | 204/224 |
| 4,587,043 | 5/1986 | Murray et al. | 252/626 |
| 4,632,740 | 12/1986 | Operschall et al. | 204/129.46 |
| 4,988,414 | 1/1991 | Westerman, Jr. | 204/15 |

OTHER PUBLICATIONS

Zurer; *Powerful New Metal–Chelating Agents Developed; C&EN* (Aug. 1, 1988).

*Primary Examiner*—Arun S. Phasge
*Attorney, Agent, or Firm*—Myers Bigel Sibley & Sajovec

[57] ABSTRACT

Apparatus and methods for decontaminating surfaces are disclosed. A housing is configured with first and second channels and first and second fluid pathways in fluid communication therewith, respectively. First and second applicators are positioned within respective first and second channels and electrodes are electrically connected with the applicators. Electric current of a first polarity is supplied to a first applicator via the first electrode, and electric current of a second polarity is supplied to a second applicator via the second electrode. Decontaminating a surface comprises supplying a first fluid to a first applicator, supplying a second fluid to a second applicator, generating an electrical potential between the first and second applicators, and contacting the contaminated surface with the first and second applicators.

46 Claims, 3 Drawing Sheets

ELECTROLYTIC DECONTAMINATION METHODS AND APPARATUS

FIELD OF THE INVENTION

The present invention relates to decontaminating surfaces, and more particularly to the decontamination of surfaces contaminated with radioactive materials.

BACKGROUND OF THE INVENTION

In a nuclear power plant, various types of equipment, including piping, vessels, pumps, valves, and the like, are exposed to radioactive contamination. Process equipment used in various petrochemical plants, refineries, and the like are exposed to naturally occurring radioactive material ("NORM"). NORM is present in varying concentrations in ground water, in oil and gas production wells, and in by-products from various mining operations. Before maintenance can be performed on equipment contaminated with radioactive material, removal of any radioactive contamination is typically required.

Currently available decontamination methods can be broadly classified under two categories: mechanical and chemical. Commonly used mechanical decontamination methods include vacuum cleaning, hydroblasting, sandblasting, blasting with other abrasives, flame cleaning, scraping, and scabbling. Unfortunately, the mechanical decontamination methods currently used have several drawbacks. The mechanical methods involving sandblasting, scraping, and other methods of surface removal typically result in radioactive material being dispersed into the air, thus presenting an additional personnel hazard. The mechanical methods are also labor intensive, thus increasing both the cost of decontamination and personnel exposure time. Additionally, the intricacy of some surfaces may render mechanical decontamination methods difficult or impractical to perform.

Commonly used chemical decontamination methods include water washing, steam clean, and scrubbing with detergents, acids, caustics, and solvents. See for example, U.S. Pat. No. 4,537,666 to Murray et al. Unfortunately, conventional chemical decontamination methods, such as that described by Murray et al., require long treatment times to adequately decontaminate a surface, typically because of slow ion exchange rates. Chemical decontamination methods often require the chemical solutions to be applied at an elevated temperature, thus increasing the complexity and cost.

An alternative to the removal of radioactive contamination is to store the contaminated object, or prohibit access to the contaminated area. For example, a contaminated vessel may be sealed off or stockpiled until the natural radioactive decay has reduced the contamination to an acceptable level. Unfortunately, this alternative has durational, economic and environmental drawbacks. Because the half lives of many radioactive particles can be as high as hundreds or even thousands of years, the storage of some contaminated equipment is impractical. Additionally, the storage of equipment contaminated with radioactivity has come under increased scrutiny from environmental groups. As a result, many companies which are currently storing contaminated equipment, will likely be forced to either decontaminate the equipment themselves or ship the equipment to radioactive waste facilities for decontamination.

SUMMARY OF THE INVENTION

It is therefore an object of the present invention to provide methods and apparatus for quickly and inexpensively removing contamination from a variety of surfaces, including both conductive and non-conductive surfaces, and porous and smooth surfaces.

It is another object of the present invention to provide methods and apparatus for decontaminating surfaces having a variety of irregularities and shapes.

It is yet another object of the present invention to provide methods and apparatus for decontaminating surfaces wherein the contamination is not dispersed into the air.

It is yet another object of the present invention to provide a decontamination apparatus that is portable and easy to use.

These and other objects are provided, according to one aspect of the present invention, by an apparatus for decontaminating surfaces comprising a housing having first and second channels, first and second fluid pathways, first and second applicators, and first and second electrodes. The housing is formed of a non-conductive material and the first and second channels are spaced apart to prevent contact between the first and second applicators positioned therein. The first and second applicators are formed of a liquid-permeable material.

The first and second fluid pathways are in fluid communication with the first and second channels, respectively. The first applicator is positioned within the first channel to receive a first fluid supplied via the first fluid pathway and configured to transfer the first fluid to a contaminated surface. Similarly, the second applicator is positioned within the second channel to receive a second fluid supplied via the second fluid pathway and configured to transfer the second fluid to a contaminated surface. The second applicator is electrically insulated from the first applicator.

The first electrode has a contact portion extending from the housing and is electrically connected with the first applicator for supplying electric current of a first polarity (charge) between the first electrode and the first applicator. Similarly, the second electrode has a contact portion extending from the housing and is electrically connected with the second applicator for drawing electric current of a second polarity (charge) between the second electrode and the second applicator. The first electrode is an anode, and the second electrode is a cathode. Alternatively, each one of the first and second electrodes may be embedded within a respective one of the first and second applicators.

According to another aspect of the present invention, the housing may comprise a plurality of first and second channels. Each one of the first and second channels are in respective fluid communication with the first and second fluid pathways. Each one of the first and second channels have a respective first and second applicator positioned therein and electrically insulated from each other. Each one of the first applicators has a first electrode in electrical contact therewith for supplying electric current of a first polarity. Each one of the second applicators has a second electrode in electrical contact therewith for drawing electric current of a second polarity. Additionally, the housing may further comprise a third fluid pathway for removal of fluid from a contaminated surface.

First fluid delivery means in fluid communication with the first fluid pathway provides a first fluid to each one of the first applicators. Similarly, second fluid delivery means in fluid communication with the second fluid pathway provides a second fluid to each one of the second applicators. Power supply means supplies electric current of a first polarity to each first electrode contact portion and draws electric current of a second polarity from each second electrode contact portion. First and second fluid delivery means may further comprise pumps for delivering fluids from first and second fluid sources to respective first and second fluid pathways.

A method for decontaminating a surface, according to the present invention, comprises the steps of supplying a first fluid to a first applicator, supplying a second fluid to a second applicator, generating an electrical potential between the first and second applicators so that electric current flows therebetween, and contacting the contaminated surface with the first and second applicators to remove contamination therefrom.

The first and second fluids may be conductive electrolytic fluids selected from the group consisting of acids, bases, and salts. Additionally, the first and second fluids may be the same. The steps of supplying a first fluid to the first applicator and a second fluid to the second applicator may be performed concurrently. The electrical potential between the first and second applicators may be between about 2 volts and about 24 volts. The above method may further comprise the step of removing the first and second fluids from the contaminated surface after the step of contacting the contaminated surface.

The decontamination methods and apparatus, according to the present invention, are advantageous for a variety of reasons. A variety of surfaces, including those having irregular contours, surface textures, and materials (both conductive and non-conductive), can be easily decontaminated. Temperature is not an important parameter; decontamination can be performed rapidly with the present invention at virtually any temperature, even below freezing when used with an appropriate anti-freeze solution.

The apparatus uses very little liquid, making it quite efficient and useful for vertical surfaces and other surfaces which cannot tolerate flooding, bathing, spraying, or other large quantities of liquid. The apparatus functions well for decontaminating isolated areas or hot spots without subjecting adjacent areas to the decontamination process and chemicals. Because of the minimal liquid required, the applicator minimizes the final waste volume produced. Also, the apparatus is advantageous because it does not contribute to airborne activity.

DETAILED DESCRIPTION OF PREFERRED EMBODIMENTS

Figure 1:
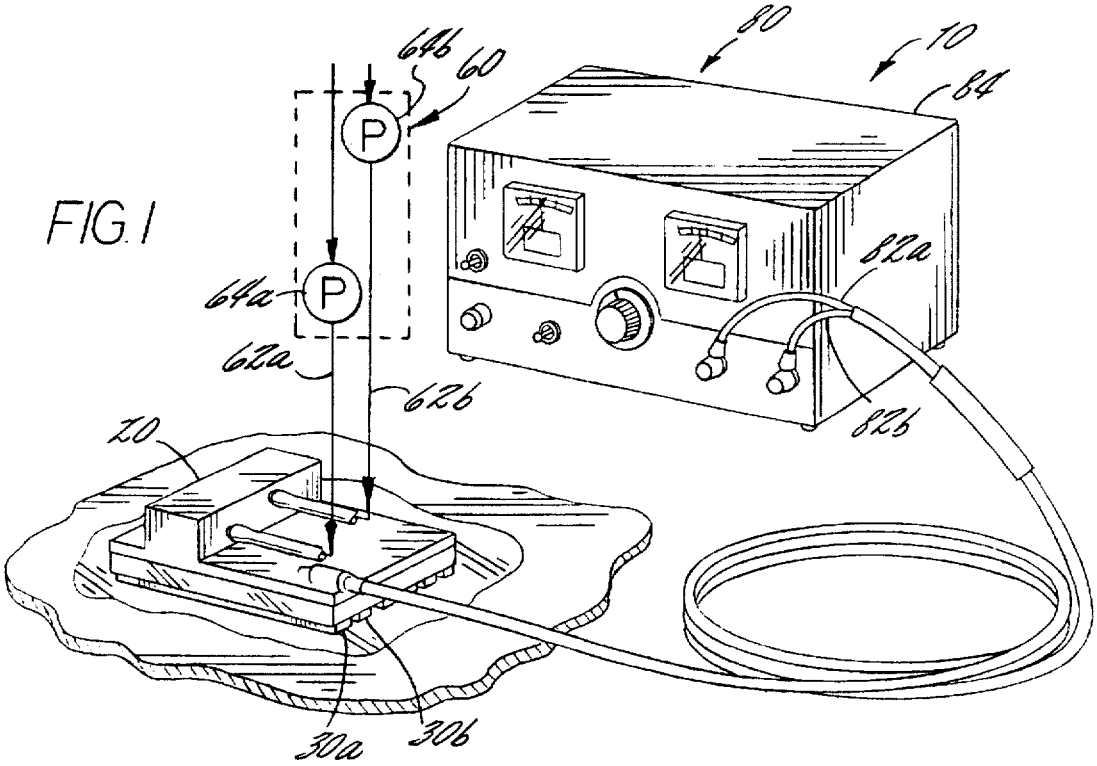
FIG. 1 illustrates a system for decontaminating surfaces, according to one aspect of the present invention.

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions may be exaggerated for clarity. Like numbers refer to like elements throughout.

Referring now to FIG. 1, a system 10 for decontaminating surfaces having either loose (smearable) surface contamination or fixed, adherent contamination (e.g., radionuclides that have become part of, or entrapped by, other deposits or oxide film) thereon, according to the present invention, is illustrated. The system 10 generally comprises a housing 20 having a plurality of applicators 30*a*, 30*b* and electrodes 32*a*, 32*b* positioned therein, fluid delivery means 60, and power supply means 80.

Figure 2:
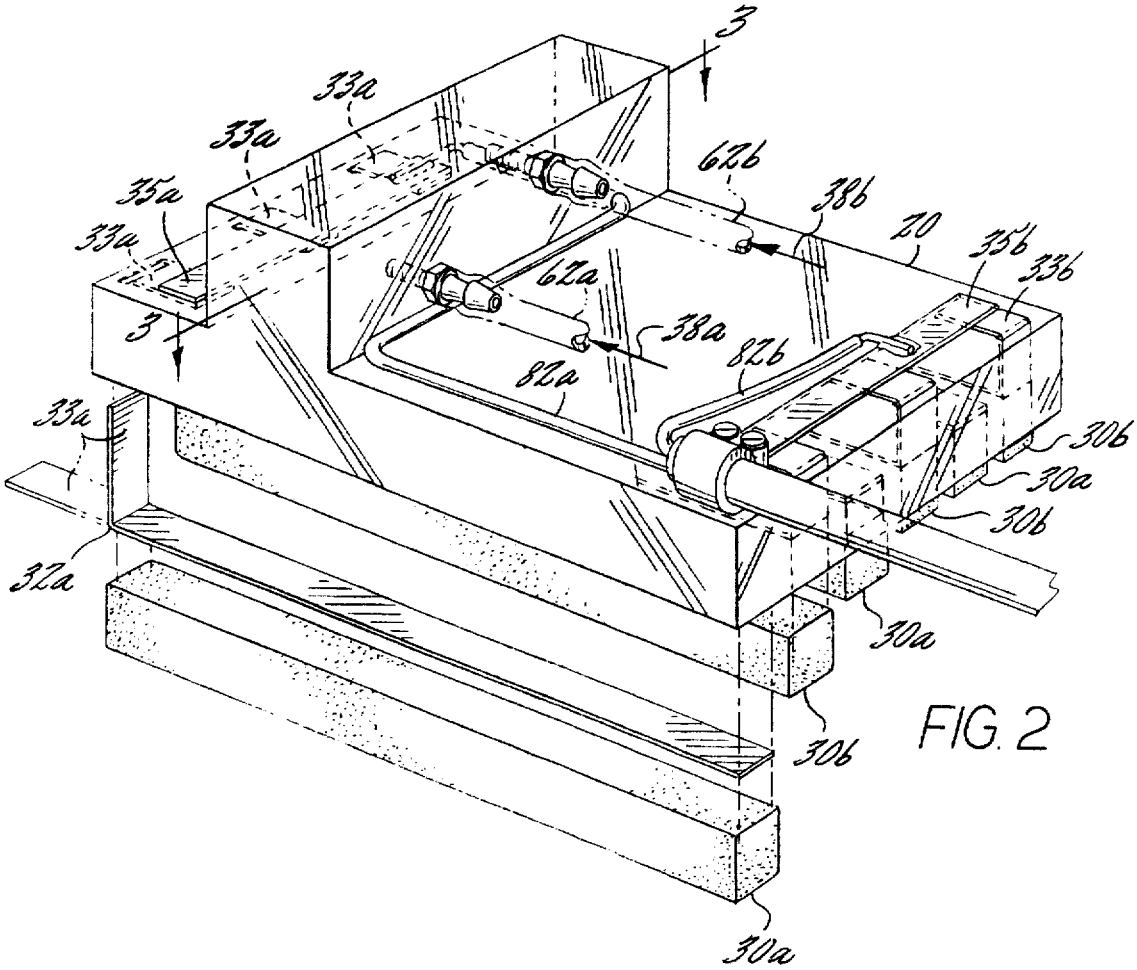
FIG. 2 is an exploded perspective view of one embodiment of the decontamination apparatus of the present invention.
Figure 3:
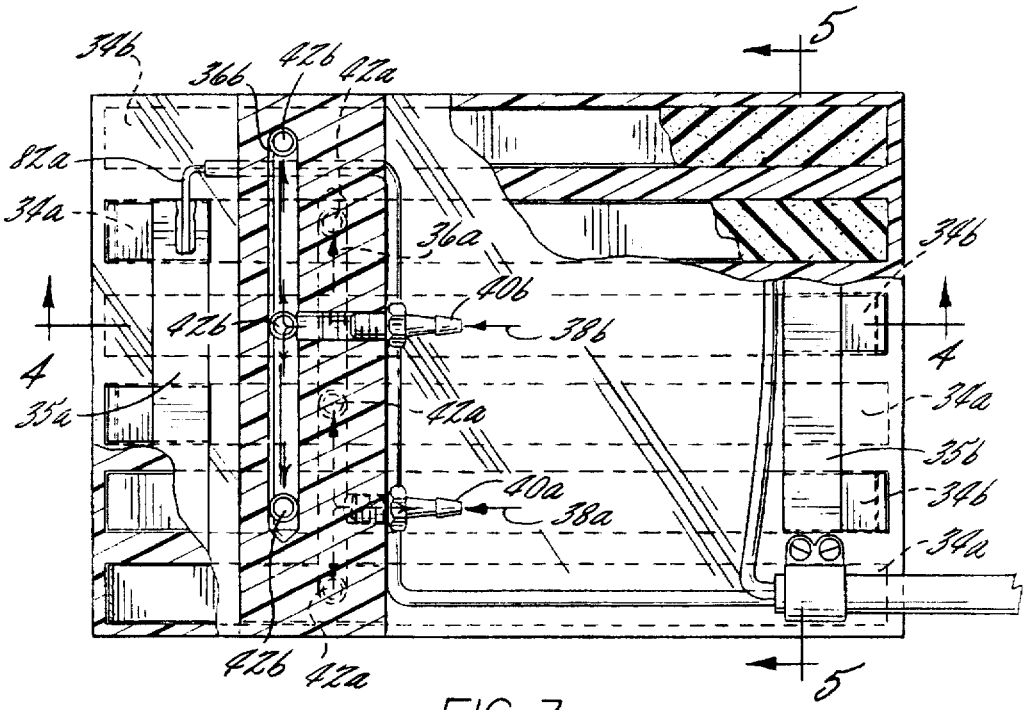
FIG. 3 is a cross-sectional view taken along lines 3—3 in FIG. 2.
Figure 4:
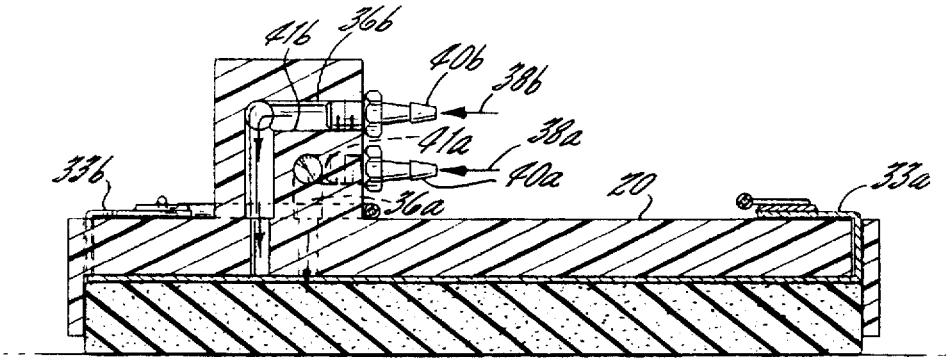
FIG. 4 is a cross-sectional view taken along lines 4—4 in FIG. 3.
Figure 5:
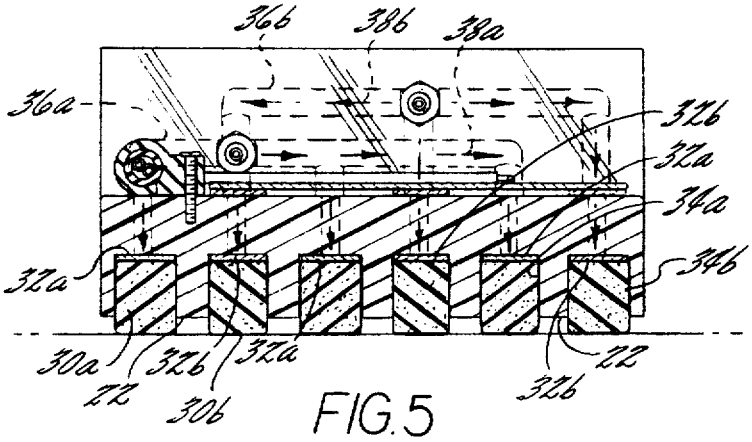
FIG. 5 is a cross-sectional view taken along lines 5—5 in FIG. 3.

Referring now to FIGS. 2–5, the housing 20 will be described in further detail. In the illustrated embodiment, the housing 20 comprises a first set of channels 34*a* configured to receive a first set of applicators 30*a*, and a second set of channels 34*b* configured to receive a second set of applicators 30*b*. A first internal fluid pathway 36*a* delivers a first electrolytic fluid 38*a* from an external reservoir (not shown) to each one of the first set of applicators 30*a*. As illustrated in FIG. 3, the first electrolytic fluid 38*a* enters the first fluid pathway 36*a* via nozzle 40*a*, which extends from the entry aperture 41*a*, passes through the pathway and exits through exit apertures 42*a* in each one of the first set of channels 34*a*, thereby wetting each first applicator 30*a*.

Similarly, a second set of channels 34*b* are configured to receive a second set of applicators 30*b*. A second internal fluid pathway 36*b* provides a second electrolytic fluid 38*b* from an external reservoir (not shown) to each one of the second set of applicators 30*b*. The second electrolytic fluid 38*b* enters the second fluid pathway 36*b* via nozzle 40*b*, which extends from the entry aperture 41*b*, passes through the pathway and exits through exit apertures 42*b* in each one of the first set of channels 34*b*, thereby wetting each second applicator 30*b*.

As is understood by those having skill in the art, an electrolytic fluid is a solution comprising a chemical compound that will conduct an electric current. Acids, bases, and salts, when dissolved in water or a nonaqueous solvent, become electrolytic fluids. Particularly preferable electrolytic fluids, according to the present invention, include chelating agents having high conditional stability constants for the radionuclides/contaminants to be removed in the 6.0 to 8.0 pH range. Preferably, chelating agents comprising blends of carboxylic acid and aminopolycarboxylic acid salts in the 6.0 to 8.0 pH range are used. Even more preferably is a pH range of 6.5 to 7.5; however, chelants within the range of 1.0 to 14 pH may be employed.

In the illustrated embodiment, the first and second sets of channels 34*a*, 34*b* are substantially parallel and have a rectangular cross-section. Each one of the first and second sets of channels 34*a*, 34*b* is separated by a non-conductive divider 22 in order to prevent contact between the respective first and second applicators 30*a*,30*b* positioned therein. Preferably, each non-conductive divider 22 is an integral part of the housing 20. The configuration of the first and second sets of channels 34*a*, 34*b* is not limited, however, to the illustrated configuration. The first and second sets of channels 34*a*, 34*b* may be concentrically configured, for example, or may have various other non-parallel configurations. Furthermore, each channel may have other cross-sectional shapes, including square, rounded, V-shaped, U-shaped, and the like.

As shown in FIG. 2, each one of the first and second applicators 30*a*, 30*b* is positioned within a respective first and second channel 34*a*, 34*b*. Each one of the first and second applicators 30*a*, 30*b* receives electrolytic fluid from each respective first and second fluid delivery pathway 36*a*, 36*b* and applies the fluid to the surface being decontaminated. In the illustrated embodiment, the applicators have a generally rectangular cross-section and are sized to fit snugly within their respective channels. However, as would be understood by those having skill in the art, the applicators may be secured within their respective channels via adhesives or other mechanical means.

Each one of the first and second applicators 30*a*, 30*b* are preferably formed from an open-cell material, for example sponge, to permit fluid to flow through the applicator to the surface being decontaminated. However, as would be understood by those having skill in the art, the first and second applicators 30*a*,30*b* may be formed from any liquid-permeable material that can adequately transfer fluid to a surface being decontaminated. Preferably, the liquid-permeable material should have good absorbency characteristics. Additionally, it is preferable that the material from which the first and second applicators 30*a*,30*b* are formed have sufficient rigidity to prohibit excessive deformation during usage. Excessive deformation may result in contact between adjacent first and second applicators 30*a*, 30*b*, thereby shorting out the electrical circuit between each respective pair of applicators. Furthermore, excessive deformation may result in inadequate transfer of fluid to the surface being decontaminated.

In the illustrated embodiment, the housing 20 comprises three pairs of first and second channels 34*a*, 34*b* having respective first and second applicators 30*a*, 30*b* therein. However, only one pair of first and second applicators 30*a*, 30*b* are required for the present invention to remove contamination from a surface. Accordingly, only one pair of first and second channels 34*a*, 34*b* are required in the housing 20. The number of pairs of first and second applicators 30*a*, 30*b* and their corresponding pairs of first and second channels 34*a*, 34*b* is optional and is dependent on the housing 20 configuration, the type of decontamination effort involved, decontamination efficiencies, and other factors that are user and task-dependent.

In the illustrated embodiment, a first electrode 32*a* is sandwiched between each one of the first set of applicators 30*a* and each one of the first set of channels 34*a*. Each one of the first electrodes 32*a* is in electrical contact with a respective one of the first set of applicators 30*a*. Similarly, a second electrode 32*b* is sandwiched between each one of the second set of applicators 30*b* and each one of the second set of channels 34*b*. Each one of the second electrodes 32*b* is in electrical contact with a respective one of the second set of applicators 30*b*.

The first and second set of electrodes 32*a*, 32*b* are configured such that first and second electrolytic fluids 38*a*, 38*b*, flowing from respective first and second internal pathways 36*a*, 36*b* are not obstructed from wetting respective first and second applicators 30*a*, 30*b*. The present invention is not limited to the illustrated configuration of electrodes and applicators. Any configuration whereby each one of the first and second electrodes 32*a*, 32*b* can make contact with each one of the respective first and second applicators 30*a*, 30*b* is acceptable. As those having skill in the art would understand, an electrode may be electrically connected with a respective applicator by inserting the electrode within the applicator, or by contacting other portions of the outer surface of an applicator. Furthermore, a plurality of electrodes may be used with each applicator as long as each electrode for a given applicator has the same polarity electrical current running therethrough.

As illustrated in FIG. 2, each one of the first and second sets of electrodes 32*a*, 32*b*, has a respective first and second contact portion 33*a*, 33*b* extending from the housing 20. Each one of the first electrode contact portions 33*a* is connected to a first bus bar 35*a*, which is, in turn, directly connected to power source 84 via electrical wire 82*a*. Each one of the second electrode contact portions 33*b* is connected to a second bus bar 35*b*, which is, in turn, directly connected to power source 84 via electrical wire 82*b*. However, the present invention is not limited to the illustrated configuration. As would be understood by those having skill in the art, each one of the first and second sets of electrodes 32*a*, 32*b* may be configured to make electrical contact with power source 84 in a variety of ways.

Referring now to FIG. 2, the first and second electrolytic fluids 38*a*, 38*b* are delivered from external fluid reservoirs (not shown) to each one of the respective first and second channels 34*a* ,34*b* via the first and second fluid supply lines 62*a*, 62*b*. The flowrate may vary depending on the size and configuration of the applicators utilized. Preferably, the flowrate should be sufficient to keep each applicator saturated. Also, the flowrate and pressure of the first and second electrolytic fluids 38*a*, 38*b* may be controlled via pumps 64*a*, 64*b*. Exemplary pumps for this purpose include peristaltic pumps, variable speed pumps, and other positive displacement pumps. Particularly preferable are peristaltic pumps having a two-tube pump head (one tube for each electrolyte channel) and controlled via an on-off switch and a voltage controller. Each pump head comprises a roller for squeezing the electrolyte fluid through the tubes. This configuration allows the pumping rate to be varied to maintain a saturated, but not supersaturated, sponge applicator. Valves are not necessary with this configuration. An exemplary peristaltic pump is a Masterflex I/P drive with a L/S Quick-Load pump head, manufactured by the Barnant Company.

As would be understood by those having skill in the art, other means of providing first and second fluids 38*a*, 38*b* to each respective first and second applicator 30*a*, 30*b* may be utilized, including gravity. For example, two centrifugal pumps including by-pass lines and throttle valves could be used to control the feed rate of electrolyte fluid. Preferably, the first and second fluid supply lines 62*a*, 62*b* are flexible and permit the housing 20 to easily obtain various orientations during operation. Exemplary fluid supply lines include plastic tubing, rubber tubing, and the like. Particularly preferable is Tygon Type R-3603 manufactured by Norton Performance Plastics Corporation.

The housing 20 is preferably sized and configured to be hand-held and easily manipulated by decontamination personnel. However, the housing 20 may have any size and shape desirable for decontaminating surfaces, and is not limited to a hand-held device. The housing 20 is preferably formed of a non-conductive material such as polycarbonate (Lexan®) and the like. The first and second nozzles 40*a*, 40*b*, configured to receive respective first and second fluid delivery lines 62*a*, 62*b*, are preferably formed of brass or other material suitable for having the respective fluid delivery lines secured thereto. Each nozzle 40*a*, 40*b* is secured within respective first and second entry apertures 41*a*, 41*b* to provide a leak-proof connection. As would be understood by those having skill in the art, the first and second nozzles 40a, 40b may be secured within respective entry apertures 41a, 41b via adhesives, threads, and the like.

Power supply means 80 preferably comprises a power source 84, a pair of electrical wires 82a, 82b connected to respective first and second sets of electrodes 32a, 32b, and means for monitoring and adjusting voltage and current flow. The power source 84 should be capable of producing a voltage potential between each pair of first and second applicators 30a, 30b of between about 2 and 24 volts. An exemplary power source 84 is a Model D-612T DC power supply manufactured by EPSCO Inc. A voltage range of about 0 to 24 volts, and an amperage range of about 0 to 15 amps are acceptable. Electrical wires 82a, 82b are preferably shielded wire; however, other means of delivering current from the power source 84 may be utilized. Conventional connectors may be used to connect each electrical wire 82a, 82b with the power source 84 and with respective first and second bus bars 35a, 35b. Alternatively, solder or conductive adhesives may be used to connect each electrical wire 82a, 82b with respective first and second bus bars 35a, 35b. As would be understood by those having skill in the art, conventional means for monitoring and adjusting electrical voltage and current flow may be utilized, including voltmeters, ammeters, potentiometers, and the like.

A primary concern is to keep electrical voltage and current flow below certain levels in order to reduce the risk of electrical shock to personnel handling the housing 20 during operation. Preferable voltages are between about 2 and 24 volts. In order to achieve effective decontamination yet keep the voltage within a range of about 2 and 24 volts, each one of a pair of first and second applicators 30a, 30b needs to be relatively close together. Preferably, each one of a pair of applicators should be separated by a distance of no more than about one quarter inch (¼"). However, as would be understood by those having skill in the art, the distance between first and second applicators in a pair is dependent on the size of each applicator as well as the configuration of each set of pairs of applicators and the voltage and current utilized.

The methods of decontamination, according to the present invention, can be characterized as "reverse electroplating." Electroplating involves the electrochemical deposition of a thin layer of metal on a conductive surface. Electroplate coatings are typically applied for decorative and/or corrosion-inhibiting purposes. The electroplating process consists essentially of connecting the surface to be plated to the negative terminal of a direct-current power source, and another piece of metal to the positive terminal, and then immersing both parts in an electrolytic fluid. The surface connected to the negative terminal becomes the cathode, and the other metal part connected to the positive terminal becomes the anode. Metal dissolves at the anode and is plated at the cathode via chemical reactions known as electrolysis. (See, *Electroplating of Metals*, Vol. 6, McGraw-Hill Encyclopedia of Science & Technology, 7th Edition, p. 261, 1992).

In general, radioactive contamination is present on equipment exposed to radioactivity in the form of a thin layer of radioactive oxide. In the present invention, the first set of applicators 30a may be connected to the negative terminal of the power source 84, and effectively act as cathodes. Correspondingly, the second set of applicators 30b are connected to the positive terminal of the power source 84, and effectively act as anodes. However, this configuration can be reversed wherein the first set of applicators 30a act as anodes and the second set of applicators 30b act as cathodes. When the radioactive oxide layer is contacted by a pair of first and second applicators 30a, 30b containing respective first and second electrolytic fluids 38a, 38b, and electrically connected to respective negative and positive terminals, the layer of oxide is "plated" onto the applicators acting as cathodes. When the housing 20 is moved in a wiping motion over the surface, the absorbent nature of the applicator material facilitates the removal of the oxide layer from the surface. Furthermore, the absorbent nature of the applicator material facilitates the decontamination of vertical surfaces by keeping the electrolytic fluids from being applied in excessive amounts.

Figure 6:
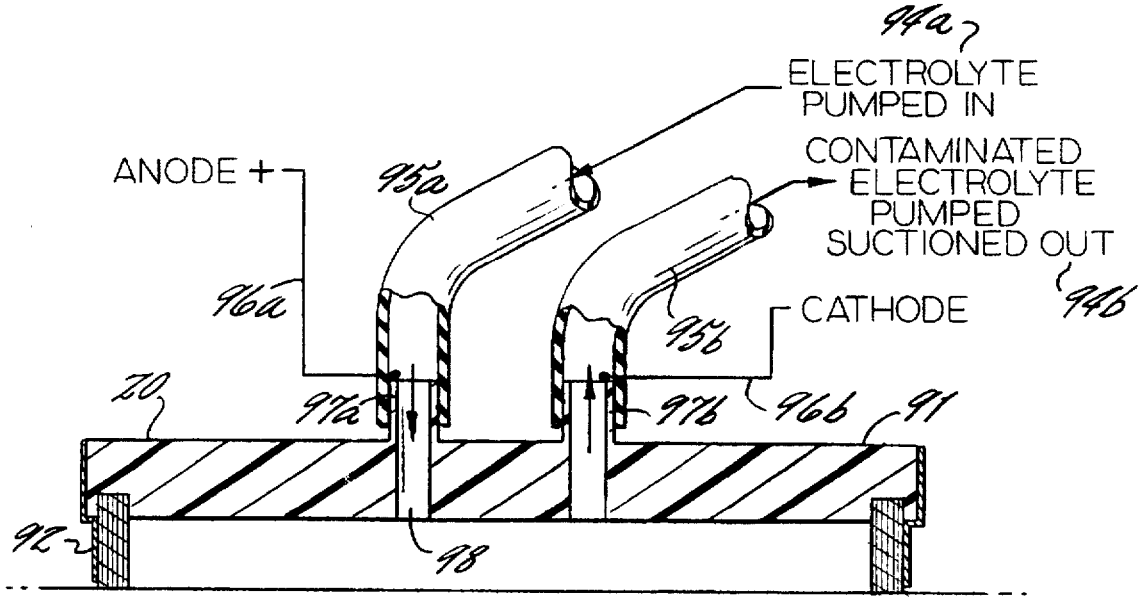
FIG. 6 illustrates one embodiment of the decontamination apparatus of the present invention, wherein a vacuum manifold is provided for removing fluid from a surface.

According to another embodiment of the present invention, illustrated in FIG. 6, decontamination may be achieved by conducting an electric current through a stream of electrolyte fluid flowing through the apparatus without the need for electrodes. The apparatus housing 20 includes a vacuum manifold 91, peripheral skirt 92 and brush 93. The brush 93 provides means for wicking the fluid from the surface of the object being decontaminated to the vacuum manifold. Preferably the brush is a fine or medium bristle brush formed from electrically non-conductive material. Alternatively, an open cell sponge, non woven material, or fabric could be used in lieu of a brush.

In this embodiment, the electrolyte fluid serves as the conductive path to and from the contaminated surface. A conductive wire 96a from the anode is connected to conductive inlet nozzle 97a, over which is positioned inlet tube 95a. A conductive wire 96b from the cathode is connected to a conductive outlet nozzle 97b, over which is positioned outlet tube 95b. Alternatively, conductive sleeves may surround each respective tube 95a, 95b, to which each respective conductive wire 96a, 96b is attached. A positive charge is thereby provided to the electrolyte fluid 94a as it is pumped into the apparatus. A negative charge is thereby provided to the electrolyte fluid 94b as it is pumped or sucked out of the apparatus.

A fluid pathway 98 is provided within the housing 20 which allows the positive-charged electrolyte fluid 94a to flow to the brush 93. The positive-charged electrolyte fluid 94a is applied to the surface being decontaminated via the brush 93. Preferably, the brush extends around the periphery of the housing 20. However, virtually any configuration of the brush 93 within the housing 20 may be acceptable to facilitate applying the positive-charged electrolyte fluid to a surface. Preferably, a gap of about one eighth inch (⅛") to about one quarter inch (¼") exists between the surface of an object being decontaminated and the vacuum manifold. The vacuum manifold 91 facilitates the removal of fluid from the surface of an object. The manifold 91 is in fluid communication with the outlet nozzle 97b. As would be known to those having skill in the art, valves and filters may be utilized to control the flow and to remove any contaminants from the fluids prior to reuse. Additionally, recirculation may be achieved via gravity or via pumping means.

Figure 7:
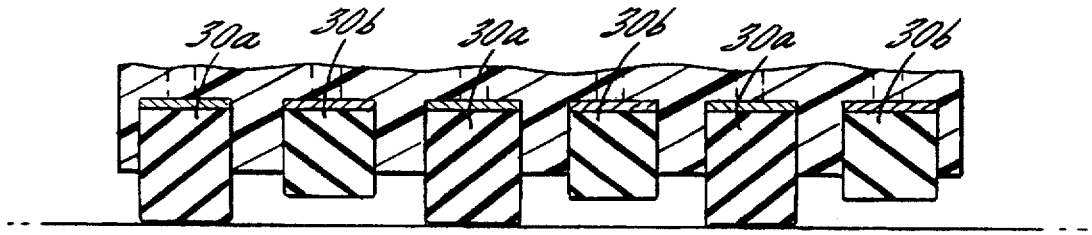
FIG. 7 illustrates an applicator configuration, wherein each cathodic applicator is recessed from the surface being decontaminated.

According to another embodiment of the present invention, illustrated in FIG. 7, the applicators 30a, 30b may have a staggered configuration. The anodic applicators 30a are configured to contact the surface to be decontaminated, while the cathodic applicators 30b are configured not to make contact. As a result, more contaminated surface area can be exposed to the underside portion of the cathodic applicator.

An advantage of the methods and apparatus herein disclosed is that both conductive and non-conductive surfaces can be quickly and easily decontaminated. For example, the present invention may be used to decontaminate concrete surfaces in addition to metal surfaces. Another advantage is that both porous and smooth surfaces can be effectively decontaminated. Yet another advantage of the present invention is that a variety of types of contamination can be removed from surfaces. The present invention is not limited to removal of radioactive contamination. In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. An apparatus for decontaminating surfaces having contamination thereon, comprising:

a housing including first and second channels and first and second fluid pathways, each of which is in fluid communication with a respective one of said first and second channels for supplying fluid thereto;

a first applicator positioned within said first channel to receive a first fluid supplied via said first fluid pathway and configured to transfer said first fluid to a contaminated surface;

a second applicator positioned within said second channel to receive a second fluid supplied via said second fluid pathway and configured to transfer said second fluid to a contaminated surface, wherein said second applicator is electrically insulated from said first applicator;

a first electrode having a contact portion extending from said housing and being electrically connected with said first applicator for supplying electric current of a first polarity between said first electrode and said first applicator; and a second electrode having a contact portion extending from said housing and being electrically connected with said second applicator for drawing electric current of a second polarity between said second electrode and said second applicator.

2. An apparatus according to claim 1, further comprising a plurality of first and second channels, each one of said first and second channels in respective fluid communication with said first and second fluid pathways, each one of said first and second channels having a respective first and second applicator positioned therein, wherein said first and second applicators are electrically insulated from each other, each one of said first applicators having a first electrode in electrical contact therewith for supplying electric current of a first polarity, and each one of said second applicators having a second electrode in electrical contact therewith for drawing electric current of a second polarity.

3. An apparatus according to claim 1, wherein said housing is formed of a non-conductive material.

4. An apparatus according to claim 1, wherein said first and second channels are spaced apart to prevent contact between said first and second applicators.

5. An apparatus according to claim 1, wherein said first and second applicators are formed of a liquid-permeable material.

6. An apparatus according to claim 1, wherein each one of said first and second electrodes are embedded within a respective one of said first and second applicators.

7. An apparatus according to claim 1, wherein said first electrode is an anode.

8. An apparatus according to claim 1, wherein said second electrode is a cathode.

9. An apparatus according to claim 1, wherein said housing further comprises a third fluid pathway for removal of fluid from a contaminated surface.

10. An apparatus according to claim 1, wherein said first and second applicators are configured such that when said first applicator is in operative contact with a surface being decontaminated, said second applicator is not in contact with said surface.

11. A system for decontaminating surfaces having contamination thereon, comprising:

a housing including first and second channels and first and second fluid pathways, each of which is in fluid communication with a respective one of said first and second channels for supplying fluid thereto;

a first applicator positioned within said first channel to receive a first fluid supplied via said first fluid pathway and configured to transfer said first fluid to a contaminated surface;

a second applicator positioned within said second channel to receive a second fluid supplied via said second fluid pathway and configured to transfer said second fluid to a contaminated surface, wherein said second applicator is electrically insulated from said first applicator;

a first electrode having a contact portion extending from said housing and being electrically connected with said first applicator for supplying electric current of a first polarity between said first electrode and said first applicator;

a second electrode having a contact portion extending from said housing and being electrically connected with said second applicator for drawing electric current of a second polarity between said second electrode and said second applicator;

first fluid delivery means in fluid communication with said first fluid pathway;

second fluid delivery means in fluid communication with said second fluid pathway; and power supply means for supplying electric current of a first polarity to said first electrode contact portion and for drawing electric current of a second polarity from said second electrode contact portion.

12. A system according to claim 11, further comprising a first fluid source and wherein said first fluid delivery means comprises a pump for delivering said first fluid from said first fluid source to said first fluid pathway.

13. A system according to claim 11, further comprising a second fluid source and wherein said second fluid delivery means comprises a pump for delivering said second fluid from said second fluid source to said second fluid pathway.

14. A system according to claim 11, further comprising a plurality of first and second channels, each one of said first and second channels in respective fluid communication with said first and second fluid pathways, each one of said first and second channels having a respective first and second applicator positioned therein, wherein said first and second applicators are electrically insulated from each other, and each one of said first and second applicators having a respective first and second electrode in electrical contact therewith.

15. A system according to claim 11, wherein said housing is formed of a non-conductive material.

16. A system according to claim 11, wherein said first and second channels are spaced apart to prevent contact between said first and second applicators.

17. A system according to claim 11, wherein said first and second applicators are formed of a liquid-permeable material.

18. A system according to claim 11, wherein each one of said first and second electrodes are embedded within a respective one of said first and second applicators.

19. A system according to claim 11, wherein said first electrode is an anode.

20. A system according to claim 11, wherein said second electrode is a cathode.

21. A system according to claim 11 wherein said housing further comprises a third fluid pathway for removal of fluid from a contaminated surface.

22. An apparatus for decontaminating surfaces having contamination thereon, comprising:

a housing including first and second channels and first and second fluid pathways, each of which is in fluid communication with a respective one of said first and second channels for supplying fluid thereto;

a first applicator positioned within said first channel to receive a first fluid having a first electrical polarity, supplied via said first fluid pathway and configured to transfer said first fluid to a contaminated surface; and a second applicator positioned within said second channel to receive a second fluid having a second electrical polarity, supplied via said second fluid pathway and configured to transfer said second fluid to a contaminated surface, wherein said second applicator is electrically insulated from said first applicator.

23. An apparatus according to claim 22, further comprising a plurality of first and second channels, each one of said first and second channels in respective fluid communication with said first and second fluid pathways, each one of said first and second channels having a respective first and second applicator positioned therein, wherein said first and second applicators are electrically insulated from each other.

24. An apparatus according to claim 22, wherein said housing is formed of a non-conductive material.

25. An apparatus according to claim 22, wherein said first and second channels are spaced apart to prevent contact between said first and second applicators.

26. An apparatus according to claim 22, wherein said first and second applicators are formed of a liquid-permeable material.

27. An apparatus according to claim 22, wherein said housing further comprises a third fluid pathway for removal of fluid from a contaminated surface.

28. A system for decontaminating surfaces having contamination thereon, comprising:

a housing including first and second channels and first and second fluid pathways, each of which is in fluid communication with a respective one of said first and second channels for supplying fluid thereto;

a first applicator positioned within said first channel to receive a first fluid having a first electrical polarity, supplied via said first fluid pathway and configured to transfer said first fluid to a contaminated surface;

a second applicator positioned within said second channel to receive a second fluid having a second electrical polarity, supplied via said second fluid pathway and configured to transfer said second fluid to a contaminated surface, wherein said second applicator is electrically insulated from said first applicator;

first fluid delivery means in fluid communication with said first fluid pathway;

second fluid delivery means in fluid communication with said second fluid pathway; and power supply means for supplying electric current of a first polarity to said first fluid, and for drawing electric current of a second polarity from said second fluid.

29. A system according to claim 28, further comprising a first fluid source and wherein said first fluid delivery means comprises a pump for delivering said first fluid from said first fluid source to said first fluid pathway.

30. A system according to claim 28, further comprising a second fluid source and wherein said second fluid delivery means comprises a pump for delivering said second fluid from said second fluid source to said second fluid pathway.

31. A system according to claim 28, further comprising a plurality of first and second channels, each one of said first and second channels in respective fluid communication with said first and second fluid pathways, each one of said first and second channels having a respective first and second applicator positioned therein, wherein said first and second applicators are electrically insulated from each other.

32. A system according to claim 28, wherein said housing is formed of a non-conductive material.

33. A system according to claim 28, wherein said first and second channels are spaced apart to prevent contact between said first and second applicators.

34. A system according to claim 28, wherein said first and second applicators are formed of a liquid-permeable material.

35. A system according to claim 28 wherein said housing further comprises a third fluid pathway for removal of fluid from a contaminated surface.

36. A method for decontaminating a surface having contamination thereon, said method comprising the steps of:

supplying a first fluid to a first applicator;

supplying a second fluid to a second applicator;

generating an electrical potential between the first and second applicators so that electric current flows therebetween; and contacting the contaminated surface with the first and second applicators to remove contamination therefrom.

37. A method according to claim 36, further comprising the step of removing the first and second fluids from the contaminated surface after said step of contacting the contaminated surface.

38. A method according to claim 36, wherein said steps of supplying a first fluid to the first applicator and a second fluid to the second applicator are performed concurrently.

39. A method according to claim 36, wherein said first and second fluids are conductive electrolytic fluids selected from the group consisting of acids, bases, and salts.

40. A method according to claim 36, wherein said first and second fluids are the same.

41. A method according to claim 36, wherein said electrical potential between the first and second applicators is between about 2 volts and about 24 volts.

42. A method for decontaminating a surface having radioactive contamination thereon, said method comprising the steps of:

generating an electrical potential between a first applicator containing a first fluid and a second applicator containing a second fluid so that electric current flows therebetween; and contacting the contaminated surface with the first and second applicators to remove the radioactive contamination therefrom.

43. A method according to claim 42, wherein said first and second fluids are conductive electrolytic fluids selected from the group consisting of acids, bases, and salts.

44. A method according to claim 42, wherein said first and second fluids are the same.

45. A method according to claim 42, wherein said electrical potential between the first and second applicators is between about 2 volts and about 24 volts.

46. A method according to claim 42, further comprising the step of removing the first and second fluids from the contaminated surface after said step of contacting the contaminated surface.

* * * * *